US009056324B2

(12) United States Patent
Fedorov

(10) Patent No.: US 9,056,324 B2
(45) **Date of Patent: *Jun. 16, 2015**

(54) SPRAYING DEVICE APPARATUS

(75) Inventor: Gennadi Fedorov, Blairstown, NJ (US)

(73) Assignee: Temptu Inc., New York, NY (US)

( * ) Notice: Subject to any disclaimer, the term of this patent is extended or adjusted under 35 U.S.C. 154(b) by 320 days.

This patent is subject to a terminal disclaimer.

(21) Appl. No.: 13/134,745

(22) Filed: Jun. 14, 2011

(65) Prior Publication Data

US 2011/0284664 A1 Nov. 24, 2011

Related U.S. Application Data

(60) Division of application No. 12/661,048, filed on Mar. 9, 2010, now Pat. No. 8,091,804, which is a continuation-in-part of application No. 12/150,345, filed on Apr. 28, 2008, now Pat. No. 8,096,489.

(51) Int. Cl.

| | |
|---|---|
| ***B05B 7/30*** | (2006.01) |
| ***B05B 7/06*** | (2006.01) |
| ***B05B 1/30*** | (2006.01) |
| ***B05B 7/24*** | (2006.01) |
| *B05B 7/12* | (2006.01) |

(52) U.S. Cl.

CPC ..... *B05B 7/064* (2013.01); *B05B 1/3013* (2013.01); *B05B 7/12* (2013.01); *B05B 7/2416* (2013.01)

(58) Field of Classification Search

CPC .... B05B 7/2416; B05B 7/2408; B05B 7/064; B05B 7/12

USPC ..... 239/345, 346, 375, 600

See application file for complete search history.

(56) References Cited

U.S. PATENT DOCUMENTS

| | | | | |
|---|---|---|---|---|
| 555,669 | A * | 3/1896 | Wold | 239/414 |
| 2,886,252 | A * | 5/1959 | Ehrensperger | 239/354 |
| 4,811,904 | A * | 3/1989 | Ihmels et al. | 239/345 |
| 6,691,931 | B2 * | 2/2004 | Kitajima | 239/346 |
| 6,874,702 | B2 * | 4/2005 | Turnbull | 239/526 |

* cited by examiner

*Primary Examiner* — Dinh Q Nguyen

(74) *Attorney, Agent, or Firm* — Stephen E. Feldman; Feldman Law Group, P.C.

(57) ABSTRACT

A spraying device includes a housing that has a spraying unit and a trigger assembly. The spraying unit is a removable insert within the housing. The spraying unit includes an air chamber that is coupled to a liquid tank. A front end portion of the air chamber has a nozzle. The air chamber receives a liquid tube that opens in the nozzle. The liquid tube receives a needle and the needle and the liquid tube are coaxial with each other. The trigger assembly controls the flow of liquid through the liquid tube by positioning a tapered front end of the needle. The trigger assembly includes a trigger that has a first position and a second position. In the first position, the opening of the liquid tube is closed by the needle. In a second position, the liquid tube is opened to discharge a liquid from an opening of the liquid tube.

14 Claims, 14 Drawing Sheets

SPRAYING DEVICE APPARATUS

RELATED APPLICATIONS

This application is a divisional of U.S. patent application Ser. No. 12/661,048, now U.S. Pat. No. 8,091,804, hereby incorporated by reference, which is a continuation in part of U.S. patent application Ser. No. 12/150,345, filed Apr. 28, 2008, now U.S. Pat. No. 8,096,489, hereby incorporated by reference.

BACKGROUND OF THE INVENTION

1. Field of the Invention

The invention relates to spraying devices. In particular, the invention relates to a spraying device having a removable spraying unit which controls the amount of liquid in the spray.

2. Description of the Related Art

The prior art has several spraying devices for dispensing liquids, such as inks and cosmetics. These devices generally include a source of pressurized air and/or liquid tank. The liquid in the tank is sprayed with a mechanism that works on the Venturi effect, wherein the flow of spray is controlled by controlling the rate of pressurized air flow.

The spraying devices in the prior art generally use a needle supported in the axial position to control the flow of the liquid of the spraying device. The spraying devices also include a valve that controls the intake of compressed air in the spraying devices. The needle and the valve are generally operated by a same trigger which proves to be inconvenient since independent control of the liquid is needed.

The controlling mechanisms of the air and the ink flow include a plurality of complex parts which are generally not removable and replaceable. For example, the components of the spraying device, such as the needle and liquid tube, are not removable either for cleaning or for refilling the liquid and are also difficult to maintain and repair. One or two parts of the spraying devices in the art are removable for maintenance, however, the complete spraying mechanism is permanently fixed in the spraying device.

Thus, there is a need for a dispensing device which includes a spraying unit that is removable so that the flow of liquids in the spray can be controlled by a trigger. Further, a spraying unit is needed that allows for fine adjustment of the liquid flow.

SUMMARY OF THE INVENTION

A spraying device is described that includes a spraying unit and a trigger assembly which are positioned in the housing of the spraying device. The spraying unit is defined by a first shell and a second shell that define a spraying unit cavity, a handle portion, and a slot for positioning a trigger. The spraying unit is a removable insert in the spraying unit cavity. The spraying unit includes a liquid tank that is coupled with an air chamber. The air chamber receives a liquid tube that receives a needle. In one embodiment, the air chamber, the liquid tube, and the needle are coaxial with a longitudinal axis.

The trigger assembly includes a hook, a spring, and a trigger. The hook is adapted to securely hold a rear end portion of the needle. The spring is coupled with a post of the trigger to retain the position of the trigger. The trigger is pivoted in the housing in a predefined arrangement. The trigger has a first position and a second position.

In one embodiment, in the first position, the trigger is positioned upwards so that. an opening of the liquid tube is closed by a tapered front end portion of the needle. In the second position, the trigger is downwardly pressed to open the liquid tube to discharge a liquid from an opening of the liquid tube. The tank includes a first opening with a collar and a second opening with a guide that has a rear cap. The rear cap receives the needle through a hole in a rear end of the cap.

In one embodiment, the air chamber has a front end portion which includes a nozzle and a rear end portion that includes a circular projection along an internal surface. The liquid tube has a front end portion which has an opening that is in close proximity with the nozzle. A rear end portion of the liquid tube opens in the tank. The needle has a tapered front end and a rear end. The tapered front end forms a pointed tip and the rear end is coupled with a device engaging trigger.

In one embodiment, the needle passes through the tank and liquid tube towards the nozzle so that the tip of the needle is positioned in the opening of the liquid tube. The needle includes a stopper which is positioned in the cap with a sealing gasket, a retainer, and a spring. The spring is positioned between the retainer and the stopper to produce a spring force which brings the needle forward to close the liquid tube when the trigger is released.

In another embodiment, the first and second body shells include a socket and a receptacle having a protrusion. The trigger includes a pair of rounded projections. Each of the projections is inserted in its respective socket to pivot the trigger. The housing has a rear end portion which includes an air inlet that receives pressurized air through a hose. The air chamber includes an air connector which has a pair of sleeves that are adapted to receive the respective protrusions of the receptacle to position the air connector in the housing.

The front end of the liquid tube is tapered internally in accordance with the tapered pointed portion of the needle so that the liquid tube is closed by the pointed front end of the needle in the first position. The amount of liquid in the air stream is controlled by an adjustable trigger.

In yet another embodiment, a spraying device for spraying liquid is disclosed which comprises a housing having a spraying unit cavity; a spraying unit which is removably located within the spraying unit cavity, the spraying unit comprising a liquid tank coupled to an air chamber, and a trigger assembly including a trigger.

In yet another embodiment, a spraying device is disclosed that is defined by a first part or a pod having and a second part. The first part is removable and replaceable with alternative first part. This allows a user to alternatively use a plurality of media frequently. The user can frequently change various medias by just changing the pod. This is needed while developing predefined makeup patterns. The user has a plurality of alternative first parts for the probable replacement. The first part has a window to see the shade of media inside the first part. In one embodiment the first part and second parts are coupled with a predefined mechanical assembly arrangement. In another embodiment, the first part and the second part are engaged and disengaged with a pair of magnets and 132 having opposite polarity. To dissemble the first part and the second part 102, a button 124 is pushed that disengage the first part from the second part.

In yet another embodiment, a spaying device is disclosed that has inbuilt air compressor that runs on batteries housed in the body of the spraying device.

DETAILED DESCRIPTION OF THE INVENTION

Figure 1:
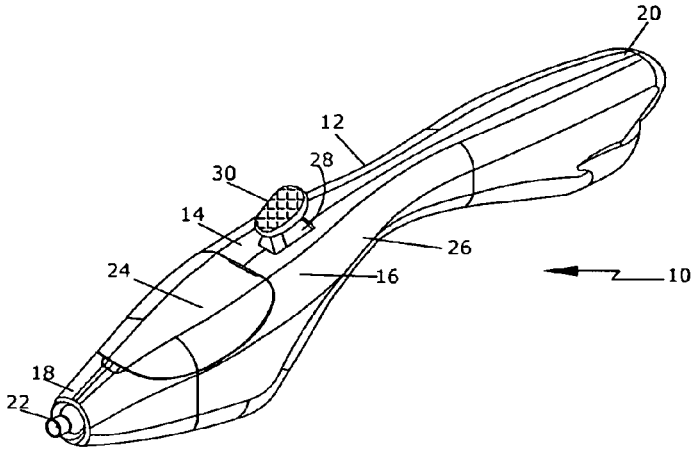
FIG. 1 is a top perspective view of a spraying device.

Although specific terms are used in the following description for the sake of clarity, these terms are intended to refer only to a particular structure of the invention selected for illustration in the drawings, and are not intended to define or limit the scope of the invention.

Referring to FIG. 1, an airbrush 10 according to a preferred embodiment of the present invention is shown that includes a housing 12 having a first body shell 14 and a second body shell 16 which are preferably made from ABS. The body shells 14 and 16 are coupled together with known techniques in the art, such as, glue and screws. The housing 12 has a front end portion 18 and a rear end portion 20. The front end portion 18 is preferably a pointed or a nose shaped portion that includes a nozzle 22 and an media tank cover 24.

A middle portion of a first body shell and a second body shell defines a handle portion 26 and a predefined slot or opening 28 which includes trigger 30. Trigger 30 has a first position and a second position. The first position is the normal position of trigger 30. The trigger 30 is moved downwards from the first position to a second position to open the nozzle 22.

Figure 2:
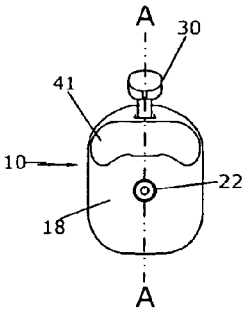
FIG. 2 is a front view of the spraying device of FIG. 1.
Figure 3:
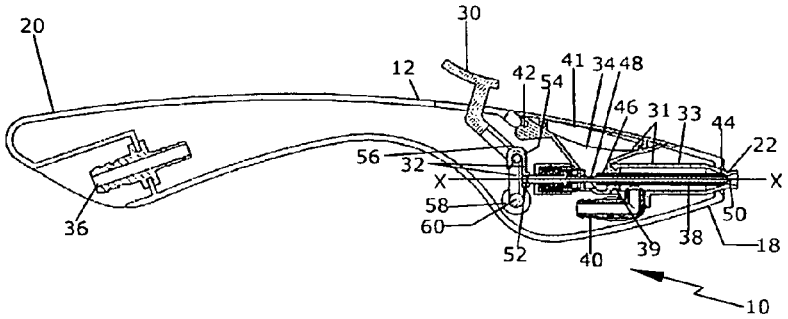
FIG. 3 is a sectional view of the spraying device of FIG. 1 taken along a plane-AA.

Referring to FIGS. 2 and 3, the front end portion 18 of the spraying device 10 includes a spraying unit 31 and a trigger assembly 32. Air spraying unit 31 includes a cylindrical air chamber 33 and a tank 34. Rear end portion 20 of the spraying device 10 includes an air inlet 36. The air chamber 33 is securely coupled at a predefined position with the tank 34. In a preferred embodiment, the air chamber 33 is approximately longitudinally coaxial with axis-X.

A front end portion of the air chamber 33 includes a nozzle 22. The rear end portion of the air chamber 33 includes a circular projection 39 along an internal surface. The air chamber 33 also receives a liquid tube 38 along a longitudinal axis-X. An air connector 40 is securely coupled with the air chamber 33.

The tank 34 is advantageously positioned in a spraying unit cavity 41 having a first body shell 14 and the second body shell 16. The tank is preferably positioned with a snap fit 42 or a press fit in the spraying unit cavity 41. The tank may be closed with a cover. The liquid tube 38 having a front end 44 and a rear end 46 is approximately coaxial with the air chamber 33. Liquid tube 38 is received in the air chamber 33 so that the rear end portion 46 opens in the tank 34 and the front end portion 44 opens in close proximity with the nozzle 22.

Liquid tube 38 includes a needle 48 which has a front end 50 and a rear end 52. Rear end 52 is coupled with a hook 54 of the trigger assembly 32 that is positioned in the housing 12. The needle 48 is coaxial with the liquid tube 38. Needle 20 passes through the tank 34 and liquid tube 38 towards a tapered opening in the front end 44 of liquid tube 38.

Trigger assembly 32 includes hook 54 which is mounted on the body of the trigger 30 that is adapted to securely hold the rear end 52 of the needle with the body of the trigger 30. The trigger 30 is preferably made from ABS or steel. Trigger 30 is pivoted in the housing 12 with a pair of sockets 58 which are located in each of shells 16 and 18, along with a pair of projections 60 of the trigger 30.

In yet another embodiment, the whole front portion of the airbrush is integrated with the tank/nozzle assembly and the whole assembly is inserted into the airbrush from the front.

Figure 4:
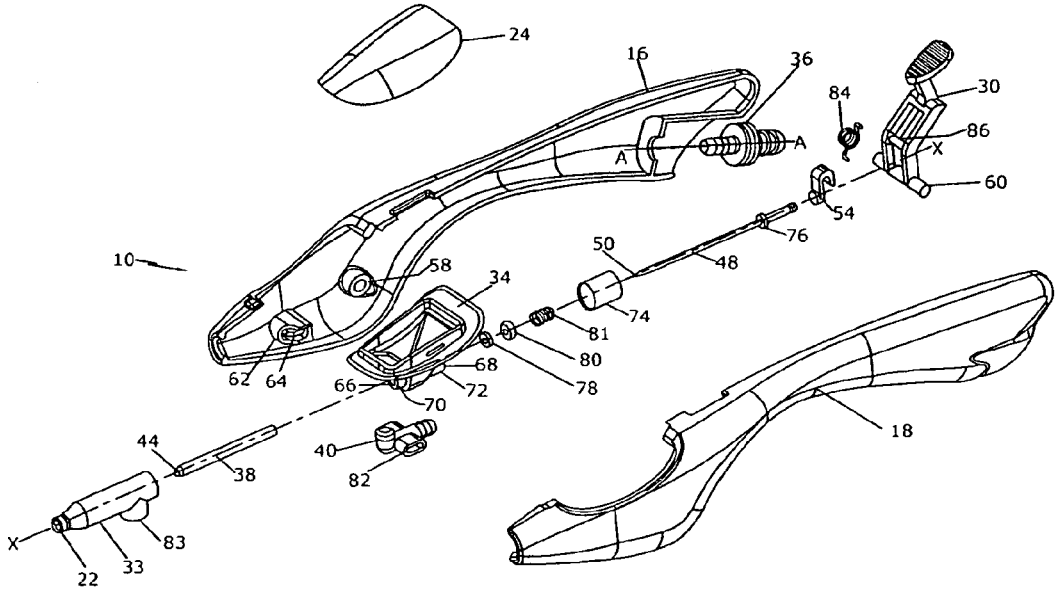
FIG. 4 is an exploded view of the spraying device of FIG. 1.

Referring to FIG. 4, an exploded view of the spraying device 10 along axis-X in accordance with the preferred embodiment of the present invention is shown. The first and second body shells 16 and 18 each include socket 58 and a receptacle 62. Each receptacle 62 includes a protrusion 64. Tank 34 includes a first opening 66 and a second opening 68 in a bottom portion of tank 34. Air inlet 36 is positioned in an opening defined by the body shells 16 and 18. A hose is preferably coupled with the air inlet to provide pressurized air from a source.

The first opening 66 has a collar 70 which includes a groove. The rear end portion of the liquid tube 38 is inserted in the tank 34 through the opening 66. The liquid tube 38 is received in the air chamber 33 which is securely coupled with the first opening 66. A rear end of the air chamber 33 is securely coupled with the collar 70 so that the groove of the collar 70 fits with the projection 39 in the end portion of the air chamber 33.

The second opening 68 of the tank includes a rounded guide 72 which is covered by a rear cap 74 that closes the opening 68. The guide 72 has a plurality of external threads on the outer surface. The cap 74 receives the needle 48 through a hole in a rear end of cap 74 having a diameter greater than the diameter of the needle 48. The needle 48 includes a stopper 76 that is positioned in the cap 74 with a sealing gasket 78, a retainer 80, and a spring 81. The spring 81 is positioned in the cap 74 between the retainer 80 and the stopper 76.

The air connector 40 includes a pair of sleeves 82. The air connector 40 is coupled with an air inlet 83 of the air chamber 33. The sleeves 82 are positioned in a receptacle 62 to receive the protrusions 64. A rubber sealing gasket is preferably adapted in the air connector 40.

The front end portion of the air chamber 33 has a nozzle 22 that receives front end 44 of the liquid tube 38 and tapered front portion 50 of the needle 48. The front end of the liquid tube 38 is tapered internally in accordance with the tapered pointed portion of the needle 48 so that the liquid tube 38 is closed by the pointed front end 50 of the needle 48 in the first position. The rounded projections 60 of the trigger 30 are positioned in the respective sockets 58 of the first and second body shells 16 and 18. A trigger spring 84 is advantageously mounted on a post 60 of the trigger 30. The hook 54 is engaged to a post 86. In an alternative embodiment the tank 34 may be is closed with cover 24 that is removable.

Figure 5:
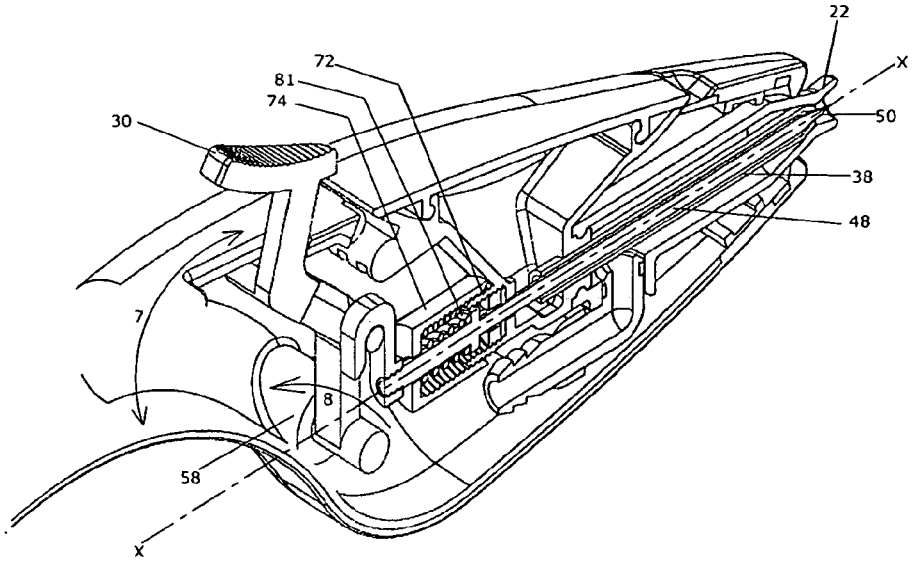
FIG. 5 is an enlarged perspective view of a front end portion of the air brush of FIG. 4.
Figure 6:
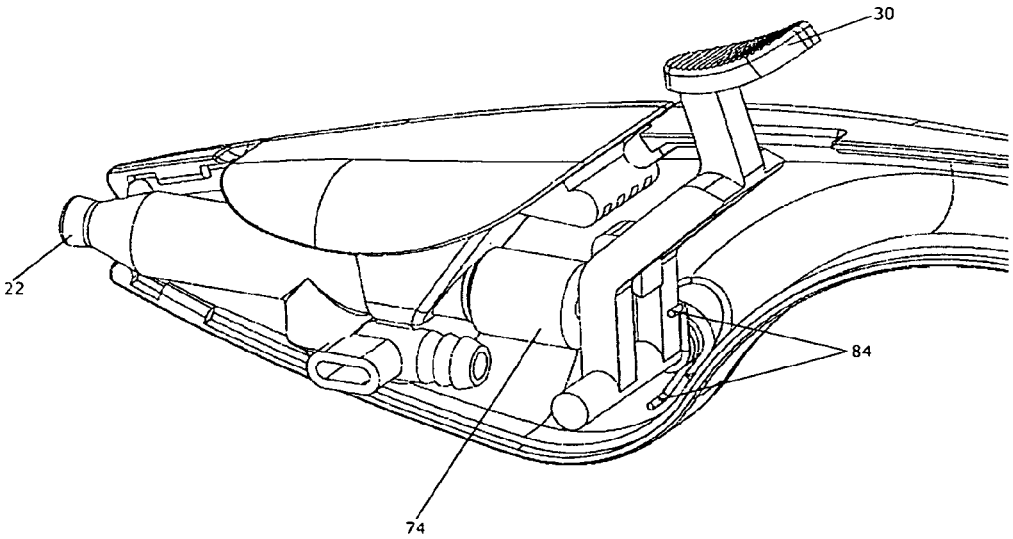
FIG. 6 is a side perspective view of the front end portion of the spraying device of FIG. 1 with a second shell removed.

Now referring to FIGS. 5 and 6, a method of controlling the flow of liquid with the trigger 30 is described. In one embodiment, the amount of liquid in the flow of the atomized mixture delivered by nozzle 22 is advantageously controlled by adjusting trigger 30. Trigger 30 is completely released in the first position. In the first position, the tapered pointed portion 50 of the needle 48 is positioned so that the opening of the liquid tube 38 is completely closed. The rear cap 74 is threadably engaged with guide 72 along longitudinal axis-X. The rear cap 74.

In a second position, trigger 30 is pressed in a backward manner as indicated by arrow 7 so that the needle 48 moves longitudinally backwards along axis- X to allow full discharge of the liquid through the liquid tube 38. When the trigger 30 is pressed from the first position to the second position, trigger 30 moves in the backward direction as indicated by the arrow 8 about the socket 58. The front end portion 50 of the needle is pulled back from the nozzle 22 by pressing the trigger 30 along axis-X.

The spring force of spring 81 has a tendency to push the stopper in the forward direction, and thereby, retains a tip of needle 48 to the original position. The trigger spring 84 pushes the trigger 30 in an upward motion to regain the first position. The spring force of spring 84 is added to the force greater than the spring force created by spring 81, both of which push the trigger to the first position when the trigger 30 is released. The first position is the normal position of the spraying device 10. The trigger 30 and the needle 48 may move to the first position as soon as trigger 30 is released from the second position.

Figure 7A:
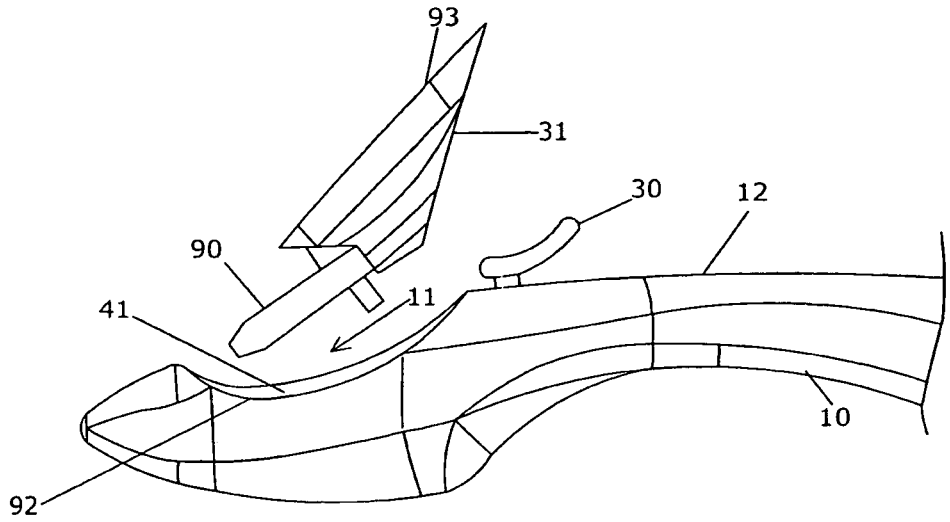
FIG. 7A-C show steps involved in a method of inserting the spraying unit in the spraying device of FIG. 1.
Figure 7B:
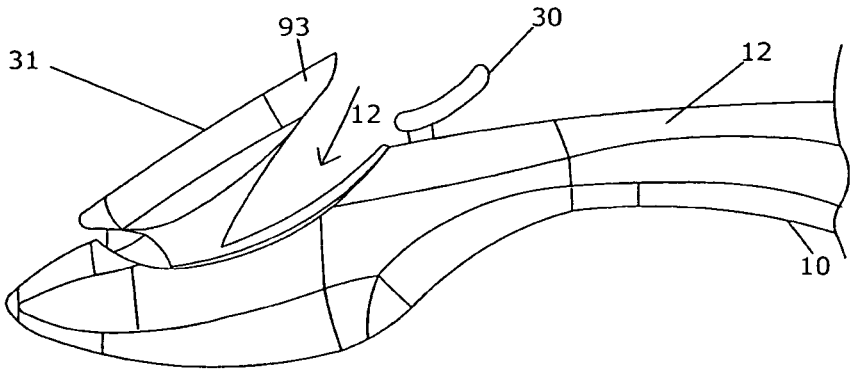
Figure 7C:
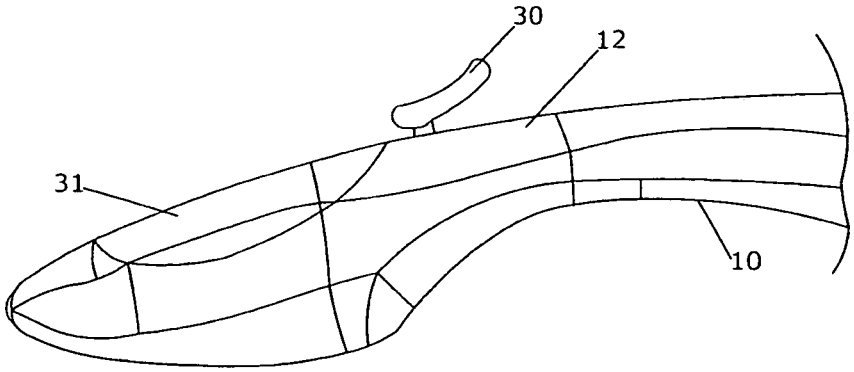

As shown in FIGS. 7A-7C, steps involved in a method of positioning spraying unit 31 in the spraying device 10 are described. In a first step, a front end portion 90 of the spraying unit 31 is inserted into the predefined cavity 41 in housing 12 of the spraying device 10 as indicated by arrow 11. In a second step, rear part 93 of the spraying unit 31 is moved in a downward manner as indicated by arrow 12.

In the third step, the rear end portion 52 of the needle 48 is securely fitted with the hook 54. Hook 54 is then securely coupled with post 86 of the trigger 30 (Ref. FIG. 4). In a fourth step, the rear end 93 of the spraying unit 31 is fitted onto with the spraying device body.

Now referring to FIGS. 1-7, in operation, liquid is stored in the tank 34 that is detachably housed in the cavity 92. The liquid is conducted to the nozzle 22 through the liquid tube 38. A pressurized gas from a source, for example, an air compressor, cam operated piston pump, battery operated piston cylinder arrangement, is supplied to the air chamber 33 through the air connector 38. An aerosol may be the source of compressed air/gas.

The pressurized air is allowed to escape through the constricted opening of the nozzle 22 that creates a low pressure zone in the tip of the nozzle 22. The Venturi Effect pulls the liquid out of the liquid tube 38 into air stream. Liquid mist of small particles is formed which is dispensed out from the nozzle 22 of the spraying device 10.

In one embodiment, the hook 54 moves the needle 48 towards the nozzle 22 opening when the trigger 30 is pressed to achieve the second position. While the trigger 30 is pressed, stopper 76 compresses spring 84 and needle 48 moves longitudinally backwards. Spring 84 is also in compression in this position. The liquid fluid enters through the opening 40 in liquid tube 38 in the passage surrounding the needle 48. The needle sealing gasket 78 restricts the flow of the liquid in the reverse direction towards the rear cap 74. The flow is controlled by pressing the trigger 30 and by maintaining various intermediate positions of trigger 30 between the first and the second position.

In one embodiment, the stopper 76 can travel in the direction of the nozzle up to a predetermined point on guide 72, at which time, the nozzle 22 is completely closed in the first position. In another embodiment, the stopper 76 can travel in the direction of the hook 54 up to the rear wall of the rear cap 74. The adjustment of the rear cap 74 allows the user to preset the amount of the liquid in the spray.

In one embodiment, the spraying device 10 may be used as a tanning air brush. The liquid can be any cosmetic, liquid, ink, etc. The airbrush 10 has an inbuilt handle portion 26 for better handling.

Figure 8:
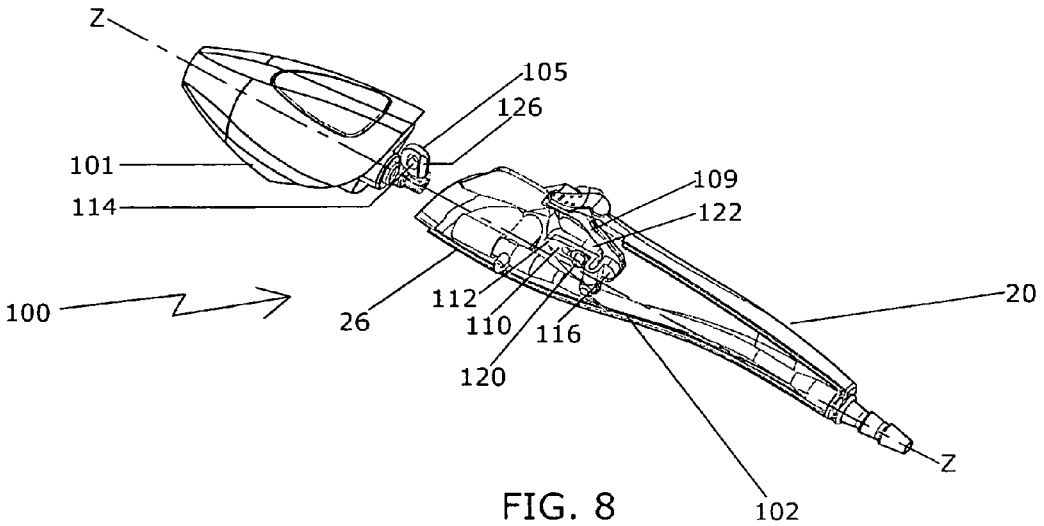
FIG. 8 is a side perspective of another embodiment of the spraying apparatus of FIG. 1 that shows internal elements of a second part.
Figure 9A:
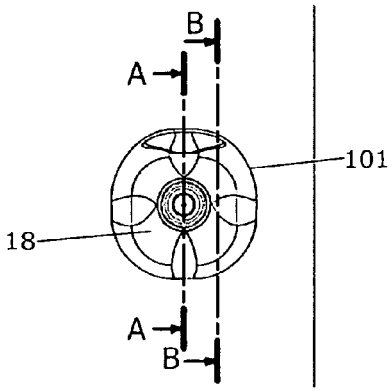
FIG. 9A is a front view of a first part of the spraying apparatus of FIG. 8.
Figure 9B:
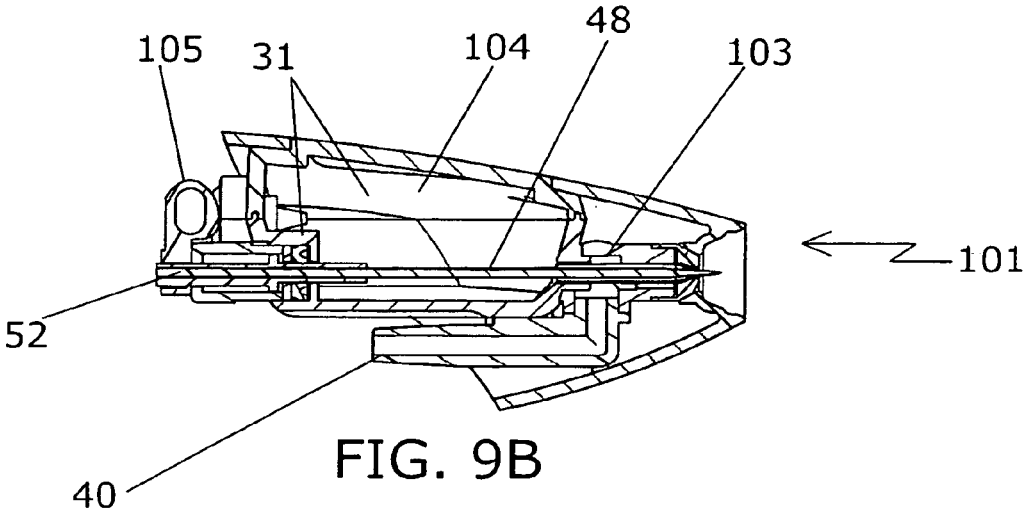
FIG. 9B is a cross sectional view of the first part taken along line-AA of FIG. 9A.
Figure 9C:
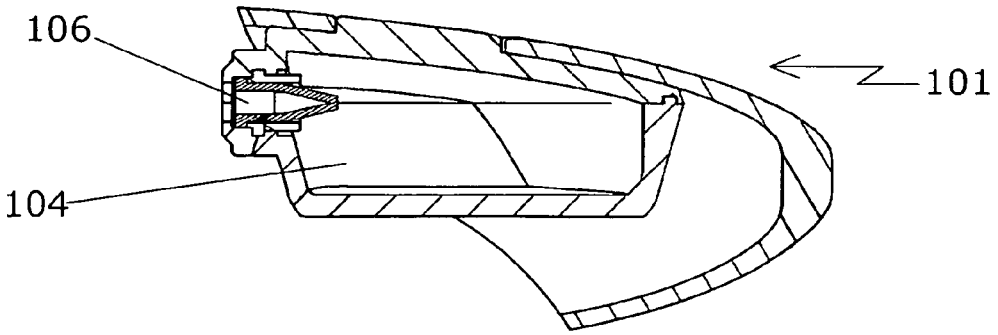
FIG. 9C is a cross sectional view of the first part taken along line-BB of FIG. 9A.

Referring to FIGS. 8 to 9C, in another embodiment, spraying apparatus 100 is defined by a first part or a pod 101 and a second part 102 that are removably engaged with each other to form a predefined configuration of spraying apparatus 100. It is, however, understood that each of the first part 101 and the second part 102 is formed by a first shell and a second shell that are permanently coupled to form the first part 101 and second part 102.

The first part 101 includes front end portion 18 whereas second part 102 defines handle 26 and rear end portion 20 of the spraying apparatus. First part 101 defines spraying unit 31 that includes cylindrical chamber 103 and tank 104. In this one embodiment, a loop 105 is securely coupled with a rear end 52 of the needle 48. A front end of the needle 48 is positioned in the nozzle 22 defined in a front end of the air chamber 103. A one way air valve 106 that preferably includes a tiny hole to receive a poker is coupled with tank 104. The one way valve 106 is preferably a duckbill valve that acts like a one way flap that allows flow of air in only one direction. Valve 106 seals the material inside tank 104 and at the same time provides air access in only one direction into the tank 104.

Figure 10:
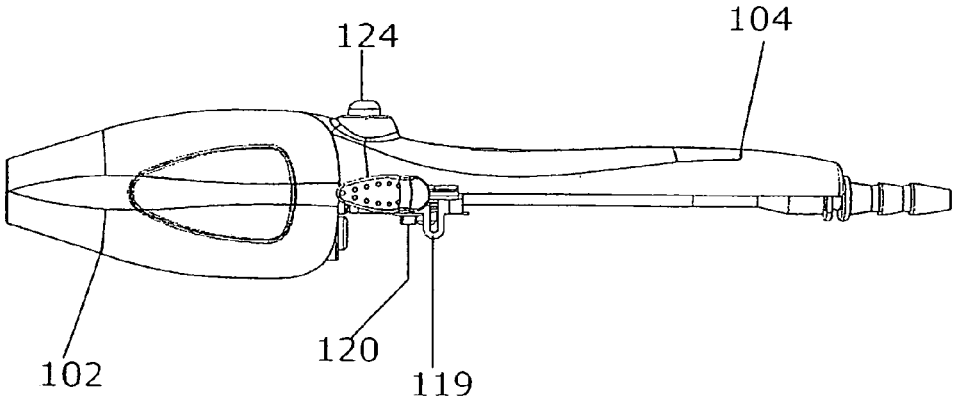
FIG. 10 is a top view of the spraying apparatus of FIG. 8.
Figure 11:
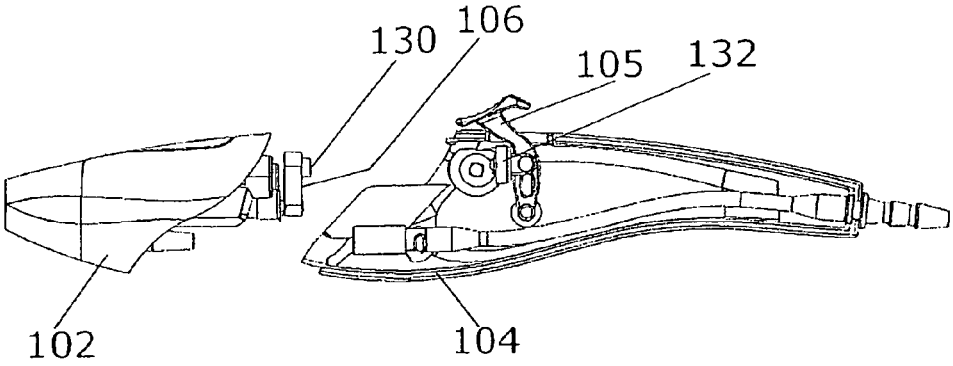
FIG. 11 is a side view of the spraying apparatus of FIG. 8.

Referring to FIGS. 8, 10 and 11, an air connector 40 receives an opening of pipe 108 with a snap that couples air connector 40 with air inlet 36. Pipe 108 is preferably made of rubber material. It is, understood, however that pressurized air flow is supplied to inlet 36, and the pressurized air flow is variable. Trigger assembly 32 is positioned in a front end portion of the first part 102. A trigger 109 is pivoted in the front end portion of the second part 102. A nozzle 178 and needle 179 are positioned on the first part 102.

The trigger assembly 32 includes trigger 109, and a link 110 having a predefined configuration. A first end 112 of link 110 includes a projection that is approximately normal to the plane of link 110. The projection is receivable in a hole 114 that is defined in the loop 105. The projection is received in hole 114 with a snap fit. The rear end 116 of the link 110 is hinged with the trigger 109. The link 110 also includes a through slot 118 and a fold 119. The slot 110 receives a head 120 of a rod 122 that is operable with a button 124 positioned on an outer portion of the body of air brush 10. The link 110 is adapted to pull needle 48 (FIG. 9B) backward to allow the makeup fluid /ink to be pulled into the air flow due to the Venturi effect when the trigger 109 is pivoted back to the second position.

The head 120 of rod 122 is securely positioned in the slot 118 preferably with a washer or a collar. The link 110 is movable along a path defined by a cavity formed by the slot 118 relative to the rod 122. The button 124 is preferably positioned close in proximity with the rod 122 on an outer body portion of first part 102. The rod 122 disengages the snapping end 112 of the link 110 from the loop 105 when the button 124 is pushed to release the second part 102 from the first part 102. In another embodiment, the rod 122 is preferably a 'Z' shaped construction so that a first end is coupled with the button 124 and a second end defining the head 120 is coupled with link 110.

To dissemble the first part 101 and the first part 102, the button 124 is pushed in to activate the rod 122 that flexes the snapping end 112 of the link 110 to disengage the snapping end from the loop 105. The first part 101 and second part 102 are disengaged as soon as the link 110 is disengaged from the loop 105. First part 101 and second part 102 are then separable from each other.

To assemble the second part 102 with the first part 101, the first part 101 is preferably kept in a fixed position relative to the first part 101. The second part 102 is then snapped in the first part 101 along a longitudinal axis- Z. The fold 119 is a shock absorber when the button 124 is pressed to activate the rod 122. The loop 105 preferably includes a chamfer 126 that directs the snapping end 112 of the link 110 into hole 114 in the loop 105 with a snap fit. First part 101 and second part 102 are preferably snapped along respective peripheries also. In a disengaged position the spraying unit 31 is accessible to a user.

It is noted the first part 101 contains the tank, spraying nozzle, needle and an intact all in one removable unit.

Figure 12:
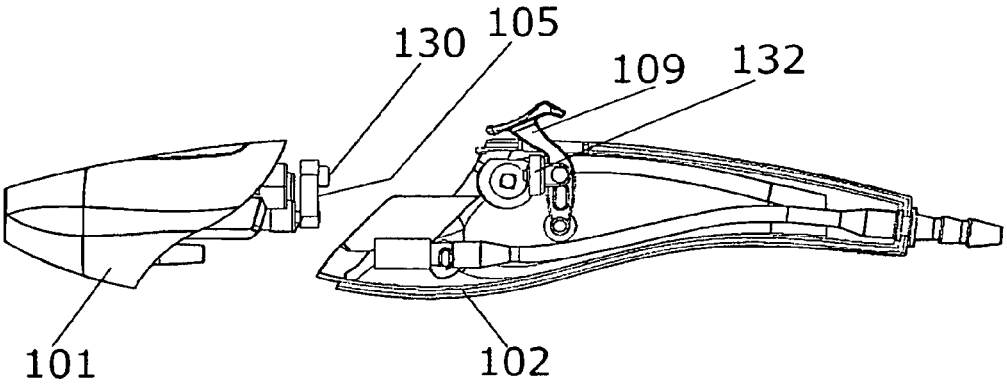
FIG. 12 is a side view of another embodiment of the spraying apparatus of FIG. 1 with that shows internal elements of the second part.
Figure 13:
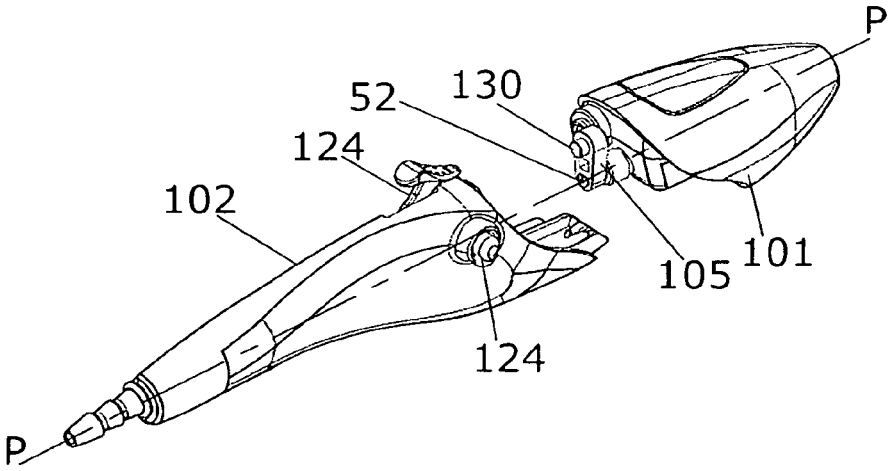
FIG. 13 is a side perspective view of the spraying apparatus of FIG. 11.

Referring to FIGS. 12 and 13, in another embodiment, the first part 101 and the second part 102 are engaged and disengaged with a pair of magnets 130 and 132 having opposite polarity. In this one embodiment, first magnet 130 is permanently coupled with the loop 105 that is pivoted at the rear end 52 of needle 48 (FIGS. 9B), and second magnet 132 is pivotally coupled with the trigger so that first magnet 130 and 132 are coaxial in the engaged position. The second magnet 132 is adapted to pull needle 48 (FIGS. 9B) backward to allow the makeup fluid/ink to be pulled into the air flow due to Venturi effect when the trigger 109 is pivoted back to the second position. The first magnet 130 and second magnet 132 are coupled with magnetic forces of attraction in the engaged position of the air brush 100.

To dissemble first part 101 and second part 102, the button 124 is pushed that hits the loop 105 that rotates about the rear end 52 (FIG. 2) of the needle 48 to disengage first magnet 130 from second magnet 132. First part 101 and second parts 102 are disengaged as soon as the loop 105 is disengaged from the trigger 109. To assemble the second part 102 with the first part 102, the first part 101 is preferably kept in a fixed position relative to the first part 102. The second part 102 is then snapped in the first part 101 along a longitudinal axis- P such that the first magnet 130 is coupled with the second magnet 132.

Figure 14:
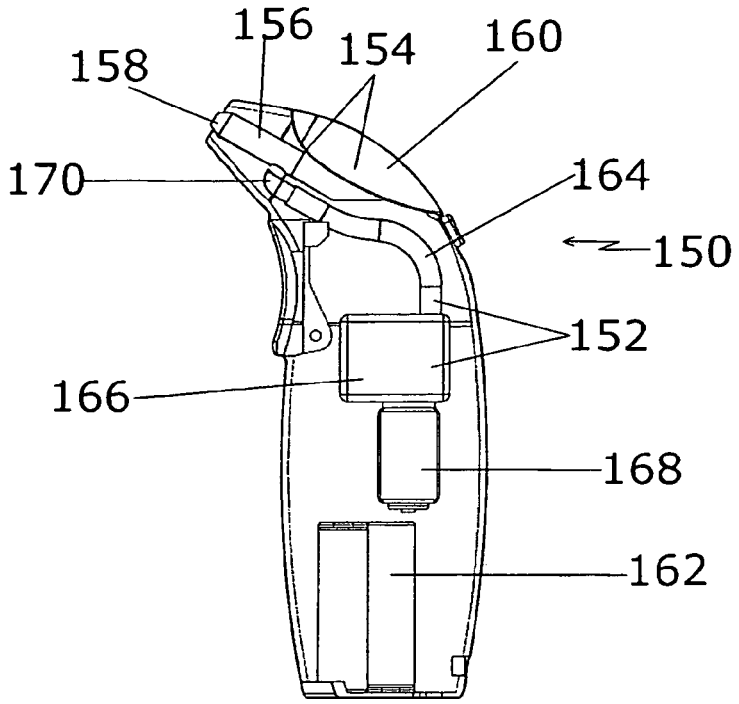
FIG. 14 is a side view of another embodiment of the spraying apparatus of FIG. 1 with a portable configuration.
Figure 15:
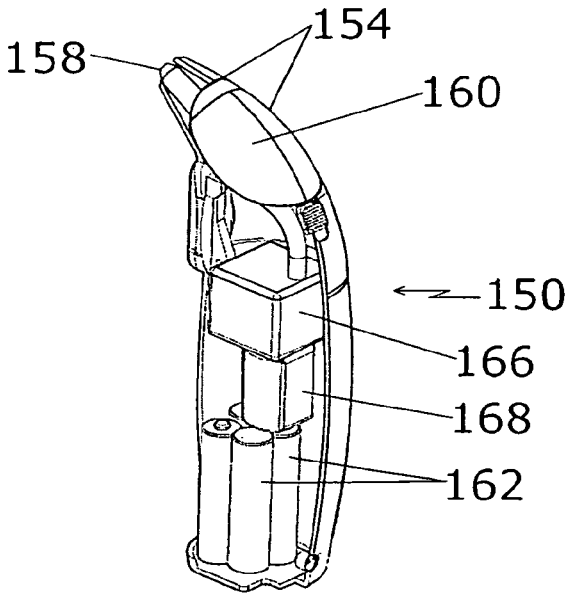
FIG. 15 is a side perspective view of spraying apparatus of FIG. 13 that shows internal components of the spraying apparatus.

Referring to FIGS. 14 and 15, in another embodiment, the spraying apparatus or the airbrush 150 essentially includes air pump assembly 152 for generating compressed air internally in the body of the apparatus 150. Spraying apparatus 150 also includes a spraying unit 154 having air chamber 156 with nozzle 158, and tank 160 that are positioned in the body that is preferably made of a pair of shells. It is, however, understood that the tank 154 of spraying apparatus 150, is removable and replaceable with an alternate tank of the spraying apparatus 150.

In this one embodiment, the spraying apparatus 150 is configured in a portable size. The air pump assembly 152 is powered by a plurality of batteries 162. The batteries 162 are preferably rechargeable type. The batteries 162 are chargeable by giving a power input at the air pump assembly 152 and batteries 162 are fixedly mounted at predefined positions in the body of the spraying apparatus 150. The air pump assembly 152 includes a flexible air tube 164, a miniature pump 166 and a DC motor 168. The pump 166 is operated by motor 168 that is powered by the batteries 162. The air tube 164 is coupled with the air connector 170 of the air chamber 156 of spraying unit 154 to supply the pressurized air.

A spray pattern is adjusted by controlling the air pressure and amount of media delivered into the air stream with a needle. The tank 154 which carries spray media is preferably removable and replaceable type. This embodiment is advantageously portable in size to carry in small pouch or user's pocket. In another embodiment of the spraying apparatus 150, the media is delivered through nozzle 158 by controlling the air pressure only. In this embodiment, a needle is not used to control of amount of media delivered through the nozzle 158.

Figure 16:
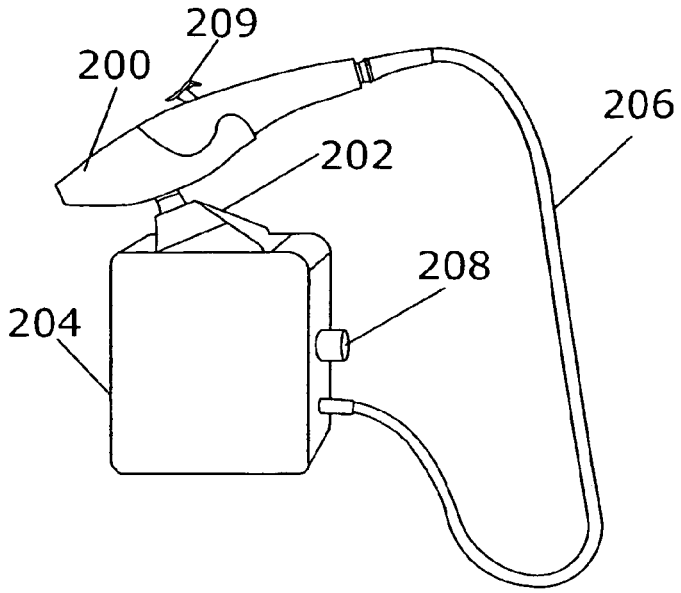
FIG. 16 is a side perspective view of another embodiment of spraying apparatus of FIG. 8 in accordance with the present invention.
Figure 17:
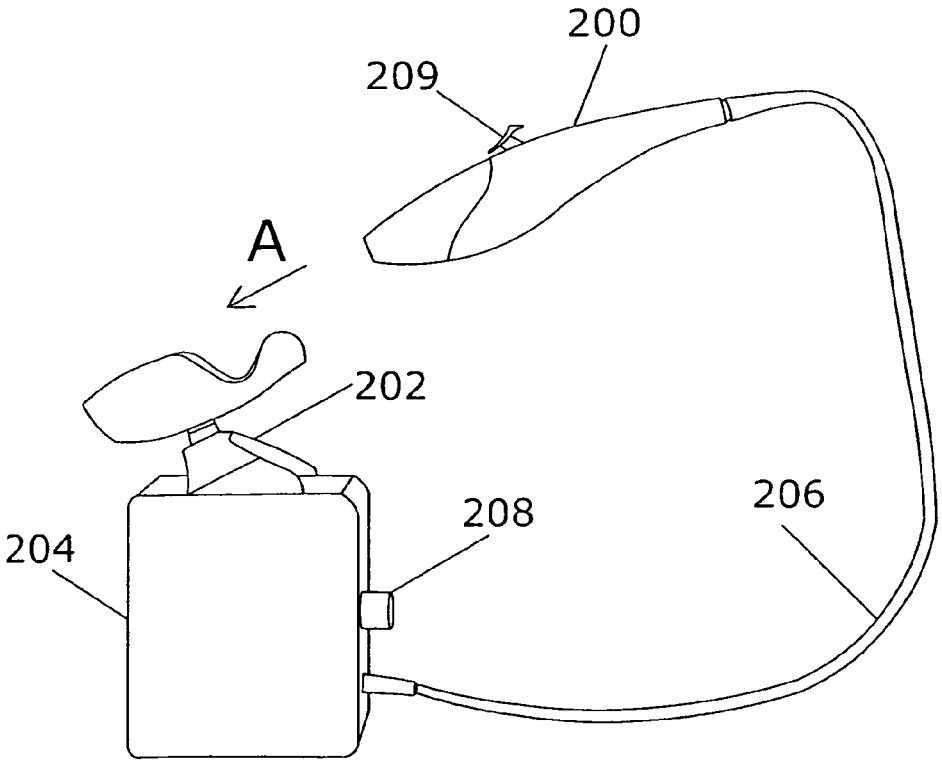
FIG. 17 is a side perspective view of spraying apparatus of FIG. 16 that shows a preferred method of positioning the spraying apparatus in a cradle in accordance with the present invention.

As shown in FIGS. 16 and 17, in another embodiment the spraying apparatus 200 includes a cradle 202 that is securely positioned on a compressor unit 204. The compressor unit 204 supplies compressed air to the spraying apparatus 200 through a hose 206. One end of the hose 206 is securely coupled to the compressor unit 204 and other end is coupled with the spraying apparatus 200. The compressor preferably includes an adjustable air pressure dial 208 to controls the air pressure. The spraying apparatus 200 is removably positionable in the cradle 202 as indicated by arrow 'A'. The compressor unit 204 preferably has a socket (Not Shown) that receives a power pin preferably from an AC adapter. The spray of atomized media is controllable by controlling the air pressure by a rotating the dial 208 at predefined positions. It is, however, understood that the flow is also controllable by fine control over the trigger.

Figure 18:
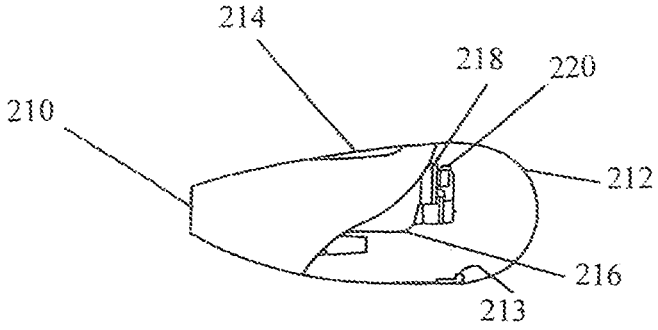
FIG. 18 is a side view of a first part of the spraying apparatus of FIG. 16 closed with a cap.

Now referring to FIG. 18, a pod or first part 210 including a spraying unit in accordance with the present invention is shown. First part 210 is closed with a cap 212. Cap 212 is removably coupled with the first part 210. Cap 212 is preferably snap-fitted with first part 210. Cap 212 preferably includes a poker 213 that is removably coupled at a predefined position in cap 212. Cap 212 is preferably made of chrome material, however, other materials such as plastic, metal.

First part 210 also defines a window 214 preferably made of transparent material to see the color or shade of media for example, foundation material, cream stored inside. First part 210 also includes a tank 216, one way valve 218, loop 220. It is, understood, however that the loop is securely coupled with a rear end 52 of the needle 48 (Ref FIG. 9B). The valve is preferably duckbill valve 218 is coupled with tank 216 that preferably includes a tiny hole to receive a poker 213. Spraying apparatus 200 is provided with a plurality of alternative foundation media shades that are stored in respective tanks 216 of first parts 210. A user alternatively uses the first part 210 with desired shade of foundation media. It is, however, understood that the configuration of the alternative first part 210' is approximately identical with first part 210, and there exists a plurality of such alternative first parts 210'.

Figure 19:
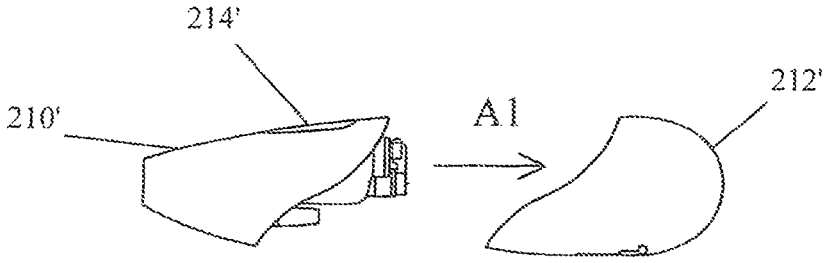
FIG. 19 is a side view of an alternative first part that shows a step of removing a cap of alternative first part in accordance with the present invention.
Figure 20:
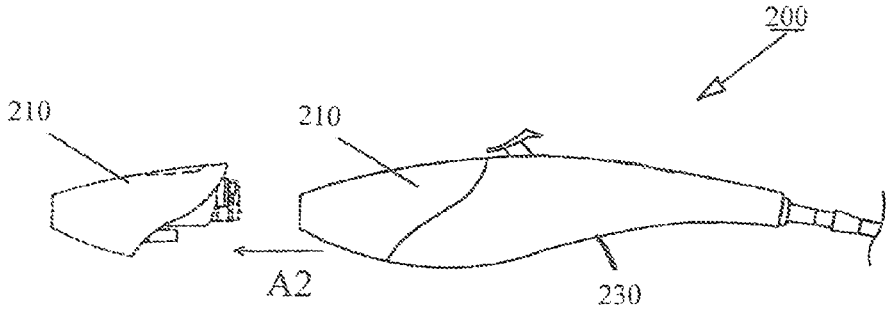
FIG. 20 shows a step of removing the first part from the spraying apparatus of FIG. 16.
Figure 21:
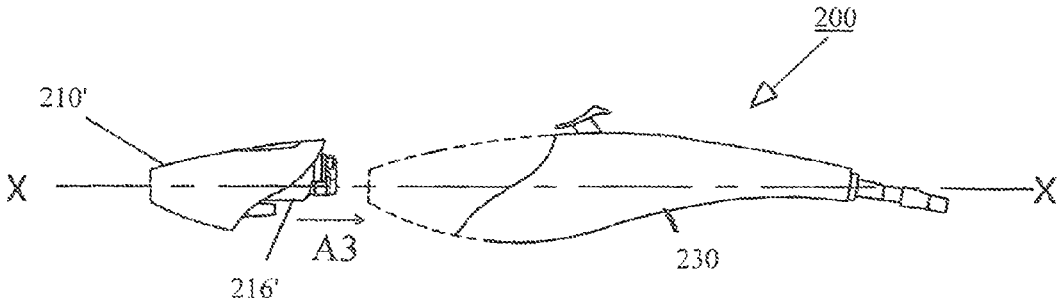
FIG. 21 shows a step of coupling the alternative first part along axis-X with the spraying apparatus of FIG. 16.

Now referring to FIGS. 19 to 21, a preferred method of removing and replacing first part 210 with an alternative first part 210' is described. In a first step, body of the alternate first part 210' is gripped and cap 212' is firmly removed from the alternate first part 210' in a direction indicated by arrow 'A1'. In a second step, body 230 of the spraying apparatus 200 is gripped and first part 210 is fiuiuly removed from spraying apparatus 200 in a direction indicated by arrow 'A2'. In the next step the alternate first part 210' is coupled with the body 230 of the spraying apparatus 200. The alternate first part 210' is positioned on the spraying apparatus 200 by moving the alternate first part 210' is in a direction indicated by arrow A3' along axis-X.

The spraying apparatus 200 is advantageously used when a user prefers frequent changing of the foundation media for producing predefined patterns of makeup. In such a situation the user frequently changes the alternative first media just by removing the first part 210 and replacing by alternative media stored in alternative first part 210' . There is no need of cleaning the foundation media every time while the media is being changed. The user advantageously maintains a plurality of alternate media stored in respective pods 210, 210'. The first part 210 defines a complete module that when coupled with the second part 230 forms the spraying apparatus 200.

In this one embodiment, the valve 218 on the ink tank 216 is a one way valve preferably of duckbill type that allows air to enter in the tank 216. Poker 213 pokes valve 218 in to regulate the intake air in case of any obstruction. The first part 210 including the spraying unit 31 (Ref. FIG. 9B) that includes tank 216 is removable from the spraying apparatus 200. First part 210 is preferably removed to alter the spraying media or to change the foundation per user requirement.

The advantage of using the duck bill valve 218 is that the tank 216 can be reused after the tank 216 is empty. Valve 216 is broken opened and refilled. Then a new duck bill valve that is approximately identical to original valve 218 is replaced to close the tank 216. Tank 216 and thereby the pod 210 is again reused. However, it is understood, that refilling a tank by breaking the valve and again closing the tank is altogether different than replacing a first part 210 with alternative first part/pod 210'.

With the use of alternative first parts 210' a user can use various shades of foundation media in one setting of makeup. The user may frequently change the pod 210 to apply a plurality of media.

Figure 22:
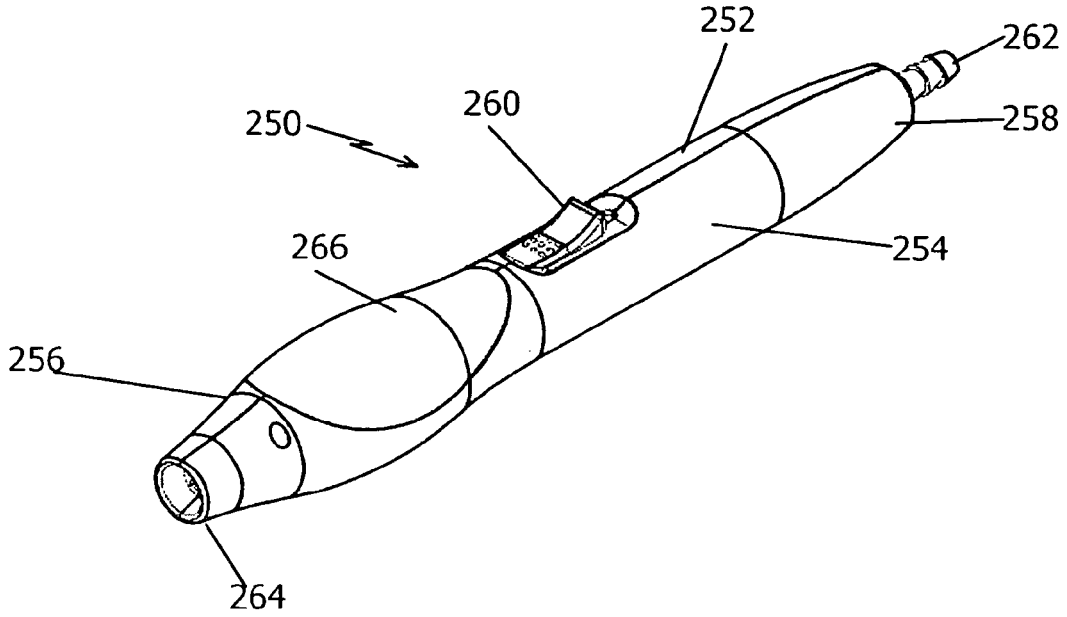
FIG. 22 is a perspective view of another embodiment of a spraying device in accordance with the present invention.

Now referring to FIG. 22, some more embodiments of the spraying device in accordance with the present invention are described. The air pen 250 includes a first body shell 252 and a second body shell 254. First body shell 252 and second body shell 254 are permanently assembled preferably by ultrasonic welding to define a body of spraying device 250. Spraying device 250 has a front end portion 256 and a rear end portion 258. A middle portion 260 defining a handle between front end portion 256 and rear end portion 258 includes a trigger 260, The rear end portion 258 includes an air intake 262 that is preferably coupled to an external pressurized gas supply. The front end portion 256 includes a nozzle 264, and a tank lid 266 that are assembled permanently by ultrasonic welding.

Figure 23:
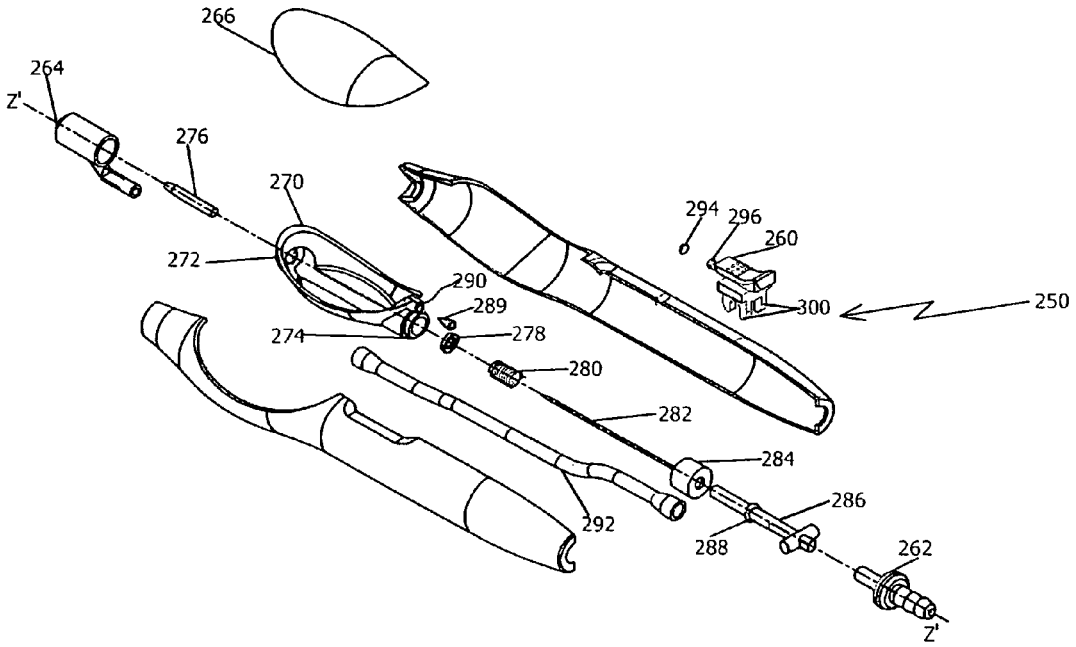
FIG. 23 is an exploded view of the spraying device of FIG. 22.

As shown in FIG. 23, tank 270 having a front opening 272 and a rear opening 274 is advantageously positioned in the tank cavity defined in the body. The spraying device 250 in accordance with this embodiment includes a nozzle 264, a media tube or liquid tube 276, tank 270, a gasket 278, a spring 280, a needle front 282, a needle cap 284, a needle rear part 286, stopper 288 and air intake 262. The nozzle 264, a media tube 276, tank 270, gasket 278, spring 280, needle front 282, needle cap 284, needle rear part 286 are assembled in a predefined sequence along axis-Z.quadrature. Air valve 289 is a small duckbill valve, which is preferably ppsitioned into a small tubular protrusion 290 positioned approximately centrally right above needle-spring assembly of the tank 270. The valve 289 and protrusion 290 are adapted to control the air intake in tank 270 through tubular protrusion 290.

One end of air tube 292 is coupled with air intake 262 and second end of air tube is coupled with air nozzle 264. A front end portion of air nozzle 264 receives front end of media tube 276, and media tube 276 receives a tapered tip of needle 282. Needle 282 is received in media the 276 through the respective openings 272 and 274 of tank 270. The needle 282 is guided by openings 272 and 274 in the tank 270. The needle 282 is received in the rear opening 274 with a gasket 278 and a spring 280 supported by the cap 284 of the needle 282.

A rear half 286 of the needle 282 is made in plastic overmold over the rear end of stainless needle. A gasket 294 is preferably positioned on the rear 286 of the needle, The rear end of the needle is securely coupled with trigger 260. The needle 262 travels along the axis-Z in accordance with the trigger 260. The needle 282 is preferably made in stainless steel material. Spring 280 punches needle 282 forward to seal the nozzle 264.

Trigger 260 is low-profile flatter and is non pivoting, but slides back and forth along the tool's body.

Trigger 260 controls only amount of liquid allowed into air flow. A foam or rubber seal 294 is preferably securely coupled with a front protrusion 296 of the trigger 260. The seal 294 is preferably glued to the front surface of protrusion 296, The rear end 286 of needle is securely coupled with trigger body with predefined protrusions 300 on trigger 269 to position the needle 282 relative to positions of trigger 260. A front air nozzle 264 with air chamber 300 is preferably permanently glued to the tank 270. The media tube 276 is preferably a copper inner tube inside tank 270. in this embodiment, the spraying device 250 is a single-use airbrush pen, which uses an external air supply, such as air compressor, aerosol or other source of compressed gas. Compressed air is delivered to nozzle 264 via any flexible PVC tube (Not seen in. FIG. 23) which is preferably coupled with air intake 262 of the pen 250. The trigger 260 has two positions, a first normal position and a second backward position.

In the second position spraying starts, during which the air intake valve 289 is opened. During the second positions the needle 282 moves backward to discharge media through the media tube 276. In idle position trigger 260 is in full-forward position and seals the valve opening 290. In another embodiment, a small poker is positioned on protrusion 296 that automatically pokes valve 290.

In this one embodiment, the spraying device 250 is preferably completely sealed such that the device 250 is preferably not refillable. The device 250 in this embodiment is a single unit and not for disassembly. The whole device is preferably thrown away when empty. The device 250 in this embodiment the trigger 260 advantageously controls the amount of liquid into air flow. The duckbill valve 290 is automatically sealed in idle position by rubber seal 294 on the protrusion 296 on the front end of the trigger 260. Gasket 278 in the opening and stopper on the needle advantageously seal possible tiny gaps in the positioning of needle 282 in the tank 270.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A spraying device comprising:

an interchangeable first part, the interchangeable first part including a shell, a tank, a valve, a connecting member, a nozzle, an air chamber, an air connector and a needle, the nozzle is defined in a front end of the air chamber, the valve is coupled with the tank and is capable of providing air into the tank, a front end portion of the needle is located in the nozzle and a rear end of the needle is securely coupled with the connecting member, the connecting member is capable of actuating the needle thereby allowing media to be pulled from the tank into the air chamber by an air flow supplied from the air connector; and a second part, the second part being a handle that is removably connected to the interchangeable first part.

2. The spraying device of claim 1 wherein the interchangeable first part is interchangeable with alternate first parts to change a desired color or shade of the media.

3. The spraying device of claim 2 wherein the interchangeable first part is approximately identical with the alternate first parts.

4. The spraying device of claim 2 wherein the interchangeable first part is replaced with the alternate first parts to apply a plurality of media to a surface.

5. The spraying device of claim 2 wherein the interchangeable first part and the alternate first parts are pods.

6. The spraying device of claim 1 wherein the valve is a duckbill valve.

7. The spraying device of claim 2 wherein the interchangeable first part and the alternate first parts further include windows made of transparent material to see the color or the shade of the media.

8. The spraying device of claim 1 wherein the valve is a one-way valve that seals the media inside the tank and at the same time provides air access in only one direction into the tank.

9. The spraying device of claim 8 wherein the tank of the interchangeable first part is refilled with the media by breaking open the one-way valve, refilling the tank and replacing the one-way valve with a new valve that is approximately identical to the original one-way valve thereby closing the tank.

10. The spraying device of claim 1 wherein the interchangeable first part sprays the media in atomized form through the nozzle.

11. The spraying device of claim 1 wherein the second part has a trigger assembly wherein the trigger assembly is communicatively coupled to the connecting member of the interchangeable first part.

12. The spraying device of claim 11 wherein the trigger assembly controls a flow of the media being sprayed from the nozzle by pressing a trigger.

13. The spraying device of claim 11 wherein the trigger assembly includes a trigger and a link, the link having a projection, wherein the projection is receivable in a hole of the connecting member.

14. The spraying device of claim 1 wherein the connecting member is a loop.

* * * * *